US010870512B2

(12) United States Patent
Montanari Ibarra

(10) Patent No.: US 10,870,512 B2
(45) Date of Patent: Dec. 22, 2020

(54) ICE CREAM AND/OR REFRIGERATED PRODUCTS BASKET

(71) Applicant: MIMET S.A., Santiago (CL)

(72) Inventor: Andres Luis Montanari Ibarra, Santiago (CL)

(73) Assignee: Mimet S.A., Santiago (CL)

( * ) Notice: Subject to any disclaimer, the term of this patent is extended or adjusted under 35 U.S.C. 154(b) by 0 days.

(21) Appl. No.: 16/045,738

(22) Filed: Jul. 26, 2018

(65) Prior Publication Data

US 2019/0031391 A1 Jan. 31, 2019

(30) Foreign Application Priority Data

Jul. 31, 2017 (CL) ..... 2017-1950

(51) Int. Cl.

| | |
|---|---|
| ***B65D 6/00*** | (2006.01) |
| ***F25D 25/02*** | (2006.01) |
| ***B65D 21/02*** | (2006.01) |
| ***B65D 25/08*** | (2006.01) |
| ***B65D 25/24*** | (2006.01) |
| ***B65D 25/28*** | (2006.01) |

(52) U.S. Cl.

CPC ..... *B65D 11/10* (2013.01); *B65D 21/0213* (2013.01); *B65D 25/08* (2013.01); *B65D 25/24* (2013.01); *B65D 25/282* (2013.01); *F25D 25/022* (2013.01)

(58) Field of Classification Search

CPC .... B65D 11/10; B65D 21/0213; B65D 25/08; B65D 25/24; B65D 25/282; B65D 1/24; B65D 1/36; B65D 5/48; B65D 5/48006; B65D 5/48036; B65D 5/48042; B65D 5/50; B65D 7/065; B65D 71/0007; B65D 85/328; F25D 25/022

USPC ..... 220/510, 511, 528, 529, 530, 531, 532, 220/533, 534, 541, 542, 543, 557

See application file for complete search history.

(56) References Cited

U.S. PATENT DOCUMENTS

| | | | | |
|---|---|---|---|---|
| 1,642,415 | A * | 9/1927 | Florang | F25D 3/08 217/122 |
| D254,187 | S * | 2/1980 | Freese | D32/3 |
| D391,696 | S * | 3/1998 | Bournay, Jr. | D32/3 |
| 5,881,906 | A * | 3/1999 | Rogers | A47L 15/502 220/488 |
| 6,161,718 | A * | 12/2000 | Monbo | A47G 21/14 220/23.87 |
| 6,321,929 | B1 * | 11/2001 | Weshler | A45C 3/04 206/217 |
| D502,295 | S * | 2/2005 | Feddema | D32/3 |
| 7,073,682 | B2 * | 7/2006 | Raches | A47L 15/502 220/488 |
| 7,418,311 | B1 * | 8/2008 | Lagassey | G07F 9/026 221/150 R |

(Continued)

*Primary Examiner* — Kareen K Thomas

(74) *Attorney, Agent, or Firm* — Karim Lagobi

(57) ABSTRACT

An ice cream and/or refrigerated products basket, useful for horizontal preserving units, irrespective for inclined or straight up models. The basket is composed of polymeric materials (plastics) which allow the product to be recycled. Unlike metal coated baskets, currently used, it does not rust, lose its shape, crack and can be easily cleaned. All these are significant and differentiating advantages when compared to the frozen product and/or ice cream baskets currently used in the commercial refrigeration market.

20 Claims, 8 Drawing Sheets

(56) References Cited

U.S. PATENT DOCUMENTS

| | | | | |
|---|---|---|---|---|
| 7,624,886 | B2 * | 12/2009 | Huang | A45C 5/045 220/507 |
| 7,861,883 | B2 * | 1/2011 | Purushothaman | A47L 15/502 206/553 |
| 8,522,998 | B2 * | 9/2013 | Crookshanks | A47L 15/501 211/41.8 |
| 2002/0139809 | A1 * | 10/2002 | Barry | A47L 15/502 220/762 |
| 2004/0094555 | A1 * | 5/2004 | Raches | A47L 15/502 220/476 |
| 2009/0302728 | A1 * | 12/2009 | Rotter | F25D 25/025 312/404 |
| 2011/0232322 | A1 * | 9/2011 | Noel | F25D 25/025 62/441 |
| 2013/0105489 | A1 * | 5/2013 | Burgess | D06F 95/002 220/533 |
| 2014/0152166 | A1 * | 6/2014 | Baum | F25D 25/025 312/404 |
| 2014/0312759 | A1 * | 10/2014 | Song | F25D 25/022 312/405.1 |
| 2015/0069066 | A1 * | 3/2015 | Choi | F25D 23/069 220/533 |
| 2016/0100699 | A1 * | 4/2016 | Levie | A47F 5/0025 220/553 |

* cited by examiner

Fig. 5
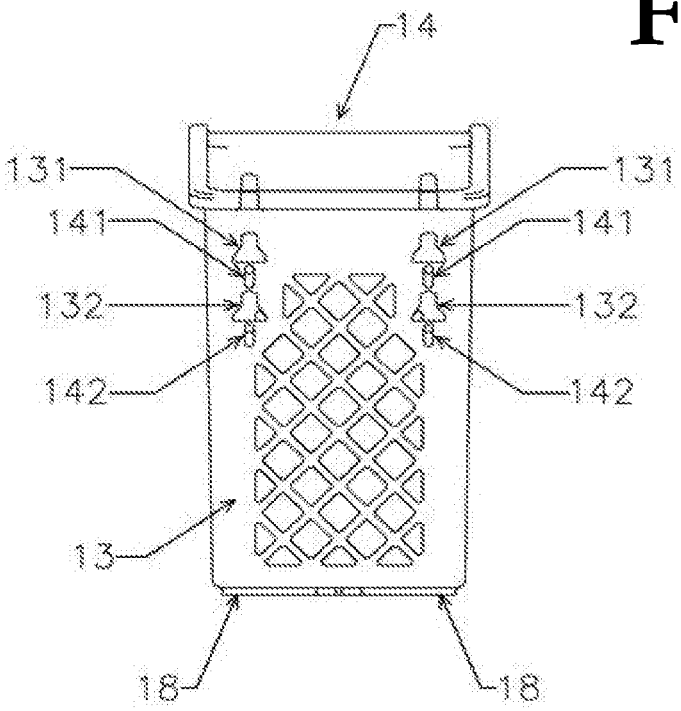
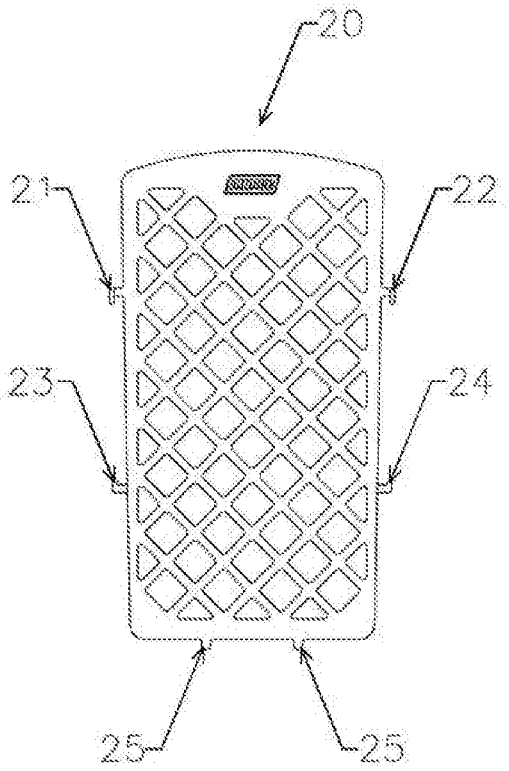
Fig. 6

ICE CREAM AND/OR REFRIGERATED PRODUCTS BASKET

CROSS-REFERENCE TO RELATED APPLICATION

The present application claims priority to Chilean patent application No. 2017-1950 filed on Jul. 31, 2017, the content of which in its entirety is included herein by reference.

FIELD OF THE INVENTION

The present invention refers to an ice cream and/or refrigerated products basket, useful for horizontal preserving units, irrespective for inclined or straight up models. The basket is composed of polymeric materials (plastics) which allow the product to be recycled. Unlike metal coated baskets, currently used, it does not rust, lose its shape, crack and can be easily cleaned. All these are significant and differentiating advantages when compared to the frozen product and/or ice cream baskets currently used in the commercial refrigeration market.

BACKGROUND OF THE INVENTION

In the science of current foods, it is well known that the freezing of food, while being a very old preservation technique, can now be applied to a wide variety of foods, such as: meats, fish, fruits, vegetables, precooked meals and, obviously, ice cream. The main advantage of freezing is that it stops, but does not eliminate, the growth of possible pathogens in food, without the need to use chemical substances, in such a manner that it ensures consumption with the maximum guarantees of hygiene, safety and quality. On the other hand, freezing gives the advantage of food preservation for a long time. Once the frozen foods have already been produced, these must be protected and placed in the freezer not only to preserve the food of the pathogens, but also to provide adequate hygiene and safety until the time of consumption. The optimum freezing temperature is stipulated at −18° C. since, in a lower temperature range, the growth of pathogens that are more resistant to temperature is not possible.

Within the frozen food products, one of great commercial popularity is ice cream, which, when it is ready to be consumed, must be stored in freezing equipment with demanding temperatures and high design parameters. The ice cream storage chain requires temperatures to be below the melting point of ice cream, which starts at around −18° C. Once the ice cream has been moved to the points of sale or distribution points, these must be refrigerated and kept in showcase freezers or refrigerators with optimal temperatures to preserve the cold chain.

Thus, within this context of frozen food products, particularly ice cream, it is necessary to have preserving machines that are capable of maintaining the products at temperatures between −18° C. and −24° C. This type of technology is already well developed in the technical field of refrigeration equipment and there is a wide variety of preserving apparatus in accordance to the needs of the market.

An important component for maintaining ice cream refrigeration, or any other frozen product refrigeration, within the equipment or preservation machines, are the container baskets, which, given their shape and configuration, must be able to contain the products and, in turn, allow cold air to circulate inside them for the correct cooling of the products. Thus, the baskets play a fundamental role in the process of preservation and exhibition of frozen products.

Ice cream baskets and/or frozen products used in horizontal preservation units are widely known in the preservation market, mainly in straight model freezers. At present, the baskets are developed in a steel wire material coated or plasticized in polyvinyl chloride (PVC), which presents a problem of oxidation over time, as a result of the wear of the plastic coating. Further, being made of steel, its handles are fixed, and therefore, they are not useful for all types of preservation units, that is, they are designed for a specific model of preservation and cannot be adapted to the different configurations that can be found in preservation machines.

In the state of the art, the Spanish Patent Serial No. ES 215882 describes a basket for freezers, which includes sliding handles, but these move in the horizontal direction, and furthermore, there is no mention that said basket is produced in polymeric materials. On the other hand, the Spanish Patent No. ES 23537, describes a basket for freezers, of a single body and that includes articulated handles for a first and second angular position, but, said handles are not removable. In addition, the document does not describe internal separators that are docked to the body of the basket. Also there is no mention that the basket is made of a polymeric material. French Patent Serial No. FR 2305352 describes a basket for freezers of plastic material, which is characterized in that it comprises means for gripping which are mounted in a manner that it slides horizontally along the upper edges of the basket and can be locked in different positions. It can, on the one hand fit into the interior supports of the freezer according to at least two standardized different widths.

With respect to the state of the art there is no document that presents the same technical characteristics of the basket disclosed in the present invention, since the documents found have baskets with fixed handles at the same height, and can only be used for the same purpose type of straight horizontal preservation unit. Described are are also baskets with fixed handles in two different heights, used only for inclined horizontal preserving unit. In the state of the art, plastic baskets with horizontally displaceable but non-removable handles and covered wire mesh baskets are also described. Although there may be commercially available products, which may include handles that can be fitted in perforations of the lip or upper edge of the basket, none of them shows handles of such length and of coupling elements that can be fixed in two different heights in such a way that the basket can be used both for straight horizontal preservation units and for inclined horizontal preservation units.

Thus, in the state of the art there are no known plastic baskets for preservation units, which include a system of independent handles, which fit the plastic basket in two possible positions of height in its smaller vertical walls, and which also include a system of interior walls or partitions that allow the cavity to be divided into varying portions.

SUMMARY OF THE INVENTION

The purpose of the present invention is to present a basket composed of a container body that includes separators of the same polymeric material (e.g., Polypropylene, PP) and two handles that can be attached to the container body, which are also made of a polymeric material (Acrylonitrile butadiene styrene, ABS) and that allow adjusting the grip height of the handles to the preserving unit. These three components of the basket (container body, separators and handles) are removable, therefore, allowing the container body of the basket to be stacked independently. Furthermore, said polymeric materials maintain an excellent condition and adaptability at low temperatures, allowing the basket to have a good working condition at low temperatures.

Another advantage of the basket of the present invention is that, by having removable and adjustable grip handles, the basket is adaptable to at least two types of preservation units available in the market, the straight type and the inclined type.

In the prior art there are no known plastic baskets for preservation units, which include a system of independent handles, which fit the plastic basket in two possible positions of height in its smaller vertical walls, and which also include a system of interior walls or partitions that allow the cavity to be divided into varying portions.

The basket for ice cream and/or refrigerated products of the present invention, is designed to deliver a solution to the industry of preserving machines by providing a standard product, which can be used in horizontal preserving machines both inclined and straight, this because the handles containing the basket, are adjustable thereby allowing changes in its position and therefore its height, in accordance with the user's need. Also, in case some of the pieces that make up the basket break, it can be replaced without the need of completely discarding the basket.

BRIEF DESCRIPTION OF DRAWINGS

The detailed description of the referred modality of the present invention will be carried out in conjunction with the figures forming part of this presentation. It is important to indicate that the figures only act as support elements for a better understanding of the invention, without them representing the basket for ice cream and/or frozen products, or the elements that comprise it, on a real or proportional scale. The invention cannot be limited only to what appears in the figures, since they represent the transcendental elements of the invention and elements that are of general knowledge in the state of the art may not be included. So, you have to:

FIG. 5 represents a side elevation view of the basket body, which allows a better visualization the height differences of its minors walls and the perforations in the lower wall of lower height that corresponds to the area of hook of the handle.

FIG. 6 represents an elevation view of the basket separator with its fixing hooks.

Figure 1:
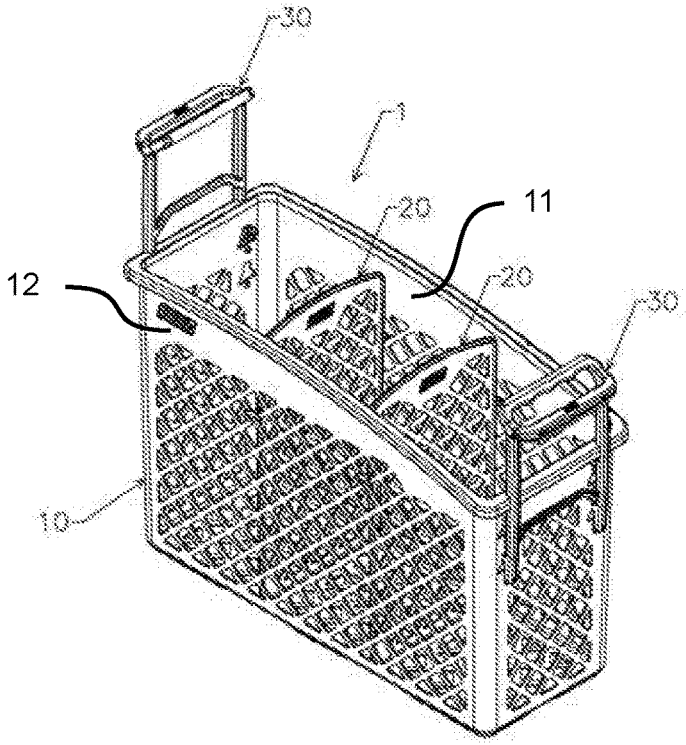
FIG. 1 represents a general perspective view of the basket for ice cream and/or refrigerated products and all its general components.
Figure 2:
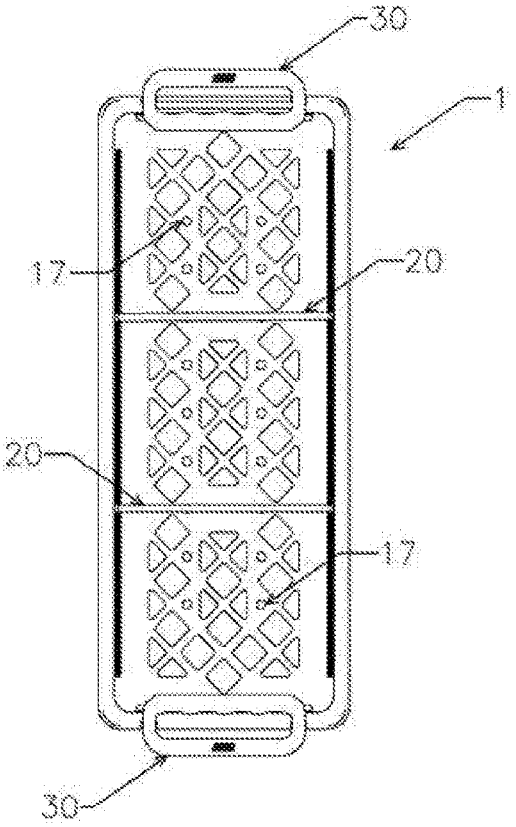
FIG. 2 represents a plan top view of the basket for ice cream and/or refrigerated products.

All the numerical references that are made throughout the description of the invention, should be considered in all the set of figures, because, it is the case that in the same paragraph are numerical references to elements that can be found in two or more different figures.

DETAILED DESCRIPTION OF THE INVENTION

For a better understanding of the present invention, it is necessary to submit the following definitions:

Preserving Unit or Machine: a refrigerating machine that transfers thermal energy. In the present case, the machine has a rectangular volume and on its upper side included are sliding glass covers. The unit or machine is able to keep refrigerated products that need to be kept at a temperature between −18° C. and −24° C., ideal for the preservation of ice cream and frozen products. Depending on the shape of its upper face, the preservation unit or machine can be straight or inclined. In the present case, it should be considered as a type of showcase for the display of ice cream or other frozen products.

Body: is the central component of the basket, which is made of a plastic material (polypropylene, PP), and is shaped to contain ice cream and/or frozen products. In addition, it works as an anchor base for the remaining components.

Separator: component made of plastic (polypropylene, PP) that is located in the interior space of the "body", which resembles a partition, being oriented to separate and generate the different independent compartments where the products contained in the plastic basket are arranged.

Handle: Component of plastic material (acrylonitrile butadiene styrene, ABS), whose main function is to hold the plastic basket and keep it in position with respect to the horizontal preserving machine.

In a very general way, the basket for ice cream and/or refrigerated products, provided for horizontal preservation, of inclined or straight models, is comprised of three components that can be disassembled from one another, all of polymeric material, which correspond to: (i) a body container with perforated walls in the form of a pattern of geometric figures; (ii) at least one internal separator including side and bottom projection devices for engaging the container body; and (iii) a set of two holding handles each consisting of at least three different types of anchors.

Thus, in the present invention, and according to what is shown in FIGS. 1 to 17, described is a basket 1 for ice cream and/or refrigerated products, provided for horizontal preserving units, regardless whether it is an inclined or a straight model, as described by the figures, basket which is comprised of three components of polymeric material removable between them, which correspond to: (i) a container body 10 of rectangular volume, formed by four vertical walls 11, 12, 13, 14 and a bottom basal wall 15, all of them perforated in the form of a geometric figures pattern, in which the two larger vertical walls 11, 12 are symmetrically identical and the two smaller vertical walls 13, 14 are of different height, the rear wall 14 being of greater height than the front wall 13; (ii) at least one internal separator 20 including lateral 21, 22, 23, 24 and lower 25 projection devices for engaging the container body 10; and (iii) a set of two holding handles 30 each consisting of at least three different types of anchors 31, 32, 33.

Figure 3:
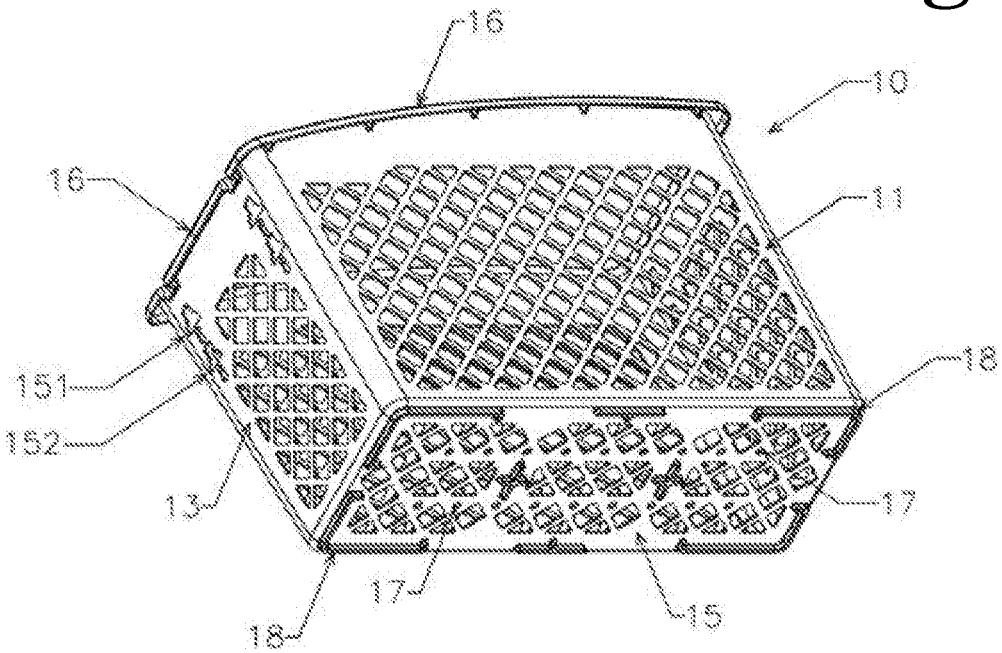
FIG. 3 represents a side perspective view of the basket, showing the bottom and the lower wall of the lower height.
Figure 4:
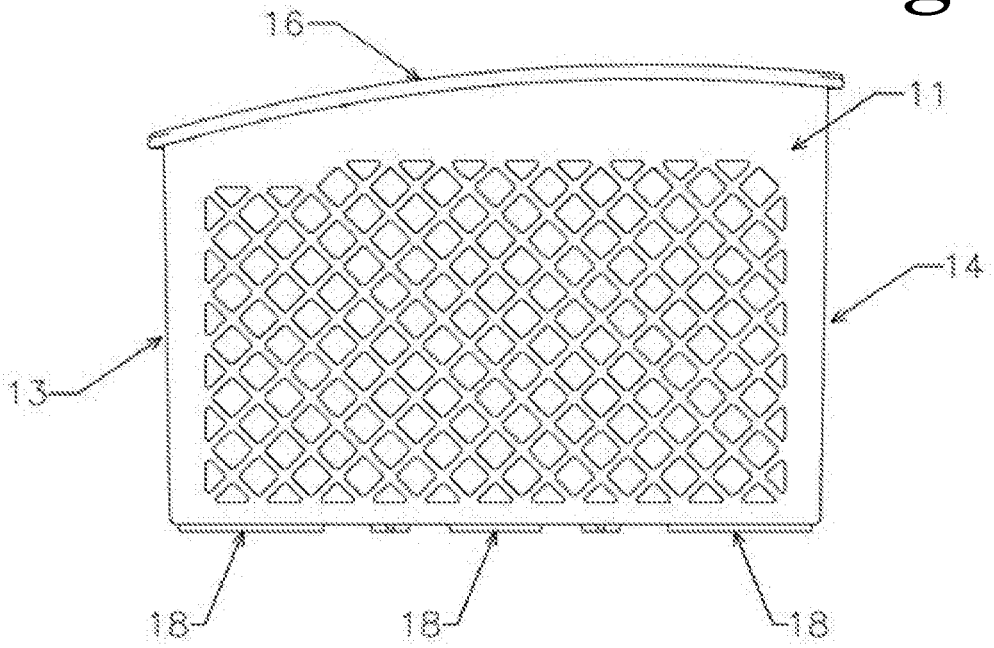
FIG. 4 represents a side elevation view of the body of the basket, showing the difference in height of the smaller walls.

In FIGS. 3 and 4, it can be seen that the container body 10, on its upper edge, has a concave curved rim 16, which allows the adjustment of the container bodies 10 when they are stacked and the coupling with one of the anchors of the handles 30.

The basket 1 for ice cream and/or refrigerated products, has geometric figures that form the weft—crosswise threads—of the perforated walls, where said geometric figures can be: a square, a rectangle, a rhombus, a rhomboid, a circle, an oval, a star of at least three points, or a combination of them. Preferably the geometric shape is a diamond or rhomboid and more preferably, the geometric shape is a rhombus, which can measure from 5 mm by 5 mm to 30 mm by 30 mm and have a separation between them from 1 mm to 10 mm. Said weft of perforations in a preferential form of diamond, gives the basket 1 greater structural rigidity, dissipating the forces at the meeting vertices between diamonds of the frame (stress nodes). On the other hand, due to the measurement of the diamonds (preferably 20 mm×20 mm) and the preferential separation of 1.5 mm between them, the thermal transfer towards its content is optimized. In the case of the container body 10, this frame functions as support and fastening for the separating component 20 without the need of having another type of additional perforation on its sides. In addition, the lower wall 15 of the container body 10 includes two longitudinal rows of circular perforations 17 of a diameter ranging between 5 mm and 9 mm, which are adapted to receive the lower protrusion devices 25 coupling of the internal separator 20. Preferably, said circular perforations 17 have a diameter of 7 mm.

As mentioned above, due to the preferably rhomboid-type weft and to the two lines of nine circular perforations 17 of diameter 7 mm, which are found in the container body 10 since the separator 20 has two cylinders 25, 6 mm in diameter and 10 mm in height, conical in its base, then it is not required two or more types of different separators, but, of a single type of separator design, as described in the present invention. This allows the separator 20 to be arranged in nine different positions, thus generating up to ten possible independent compartments for the frozen and/or frozen products in the basket 1.

In FIGS. 3, 4 and 5, it can be seen that the outer surface of the lower wall 15 of the container body 10, includes eight spacers 18 that support and move away the base of the basket 1 with respect to the floor and prevent it from touching the compressor slot of the preserving machine, ensuring a flow of cold air constant in the bottom of the preserving machine, favoring in this way the thermal transfer for the preservation of such content found in the bottom of the basket.

Figure 12:
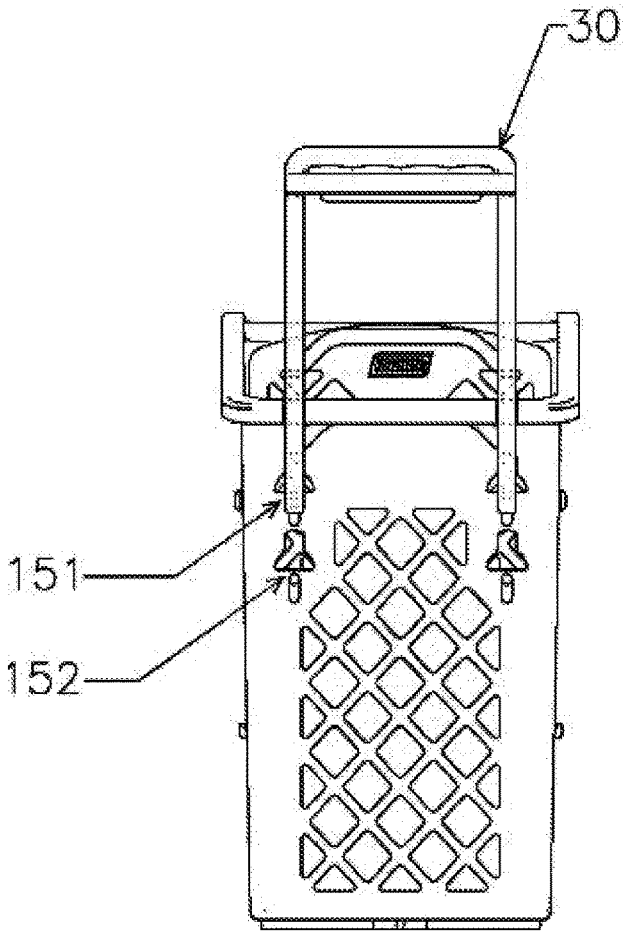
FIG. 12 represents a front elevation view of the basket showing a pair of perforations of the "inverted wine cup" type, which allows it to locate the handle and regulate its height.
Figure 13:
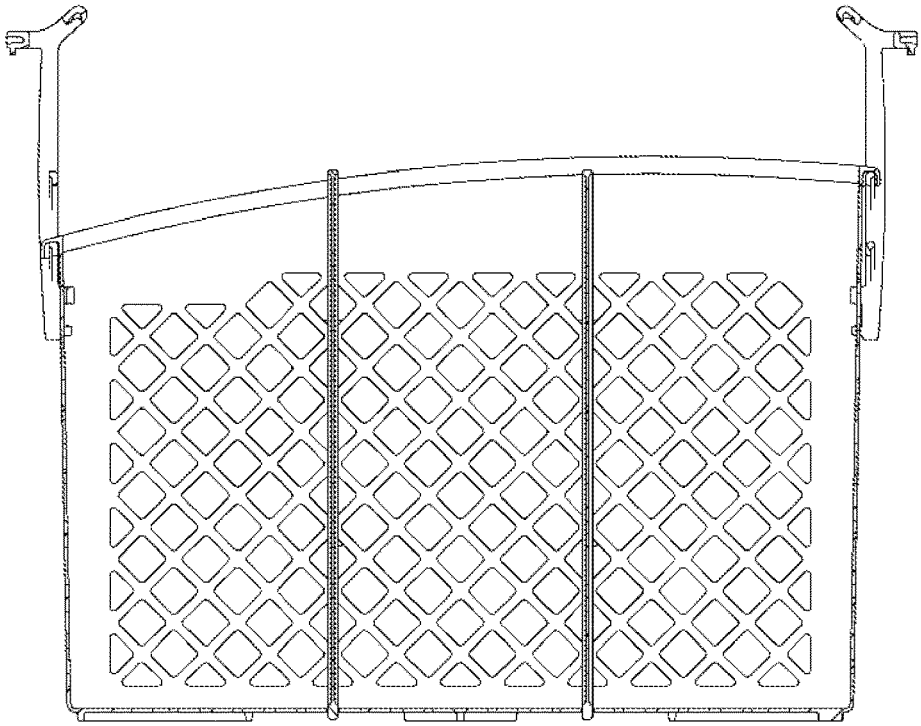
FIG. 13 represents a side view of the basket where both handles are at the same level (height).
Figure 14:
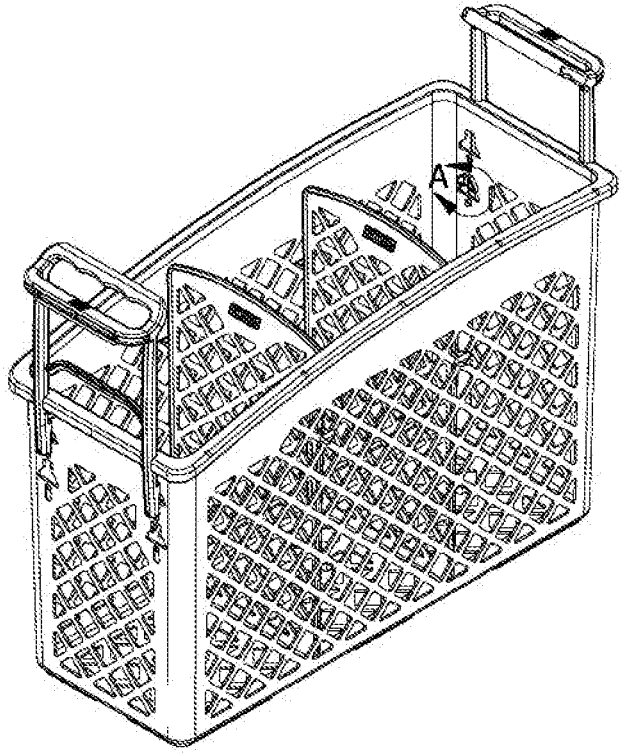
FIG. 14 represents a perspective view of the basket where both handles can be seen at the same level (height), i.e., in a straight position.
Figure 15:
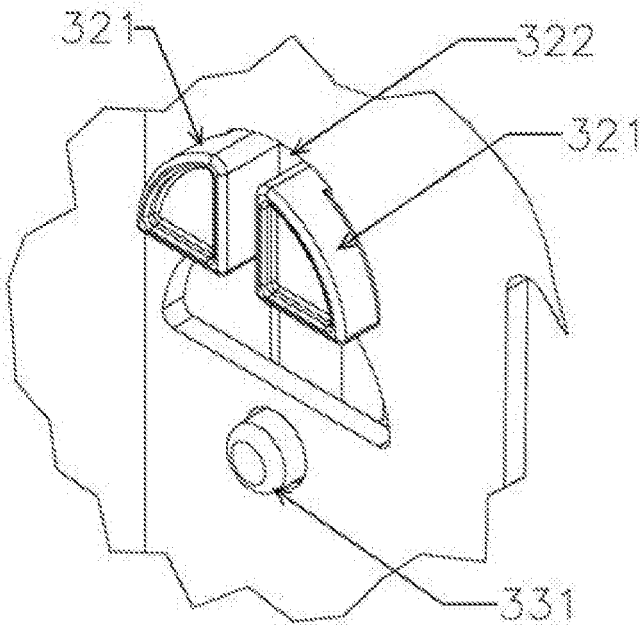
FIG. 15 represents a type of clip type anchoring system.
Figure 16:
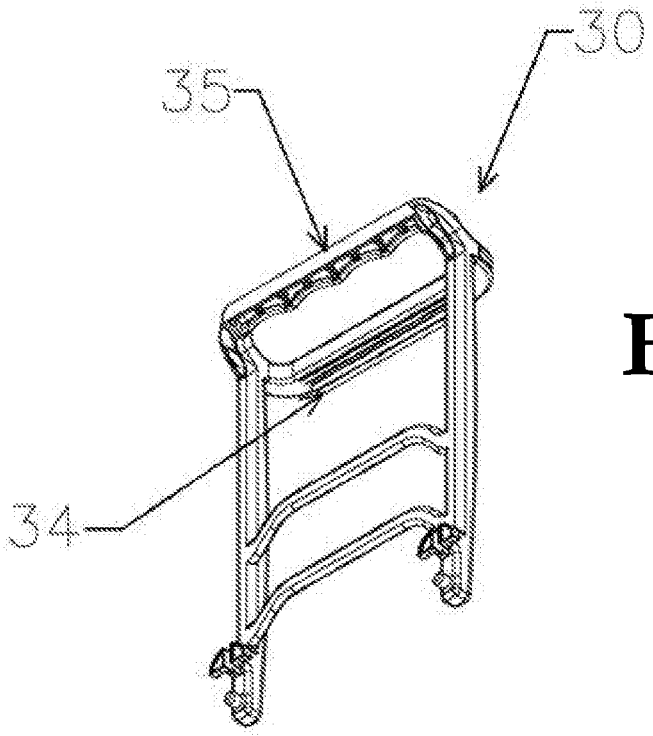
FIG. 16 represents the removable handle of the basket, emphasizing the bar anchor and the opposite part of the handle.
Figure 17:
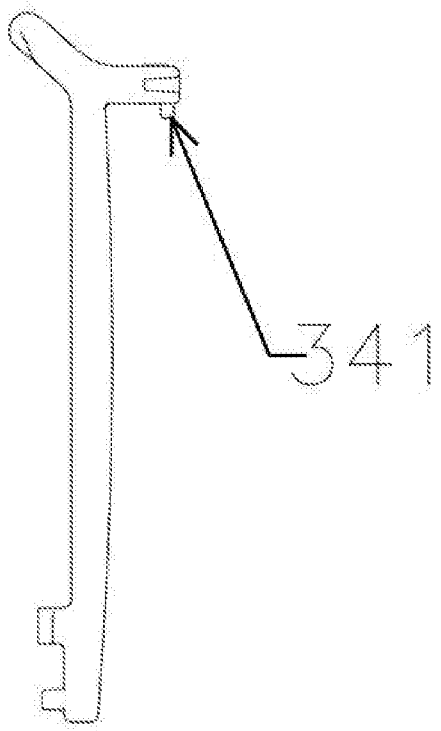
FIG. 17 represents the cross bar of the handle of the basket.

In FIGS. 3, 5 and 12, it can be seen that the smaller vertical walls 13, 14 include in their upper area, in a first level, a first pair of perforations 131 type "inverted wine cup", each one close to each edge of each wall, and immediately, under said "inverted wine cup" type perforations 131, a first pair of circular perforations 141 of 6 mm diameter is included, said first pair of perforations 131 type "inverted wine cup" next to said first pair of circular perforations 141, form a first level set 151 for the coupling of the handles 30. In addition, in a second level lower than the first level of the first level set 151 in each of the smaller vertical walls 13, 14, a second pair of perforations is included 132 "inverted wine cup" type, each one close to each edge of each wall, and immediately, under said perforations 132 type "inverted wine cup", a second pair of circular perforations 142 of 6 is included mm in diameter, said second pair of perforations 132 type "inverted wine cup" next to said second pair of circular perforations 142, form a second level set 152 for the coupling of the handles 30.

Figure 7:
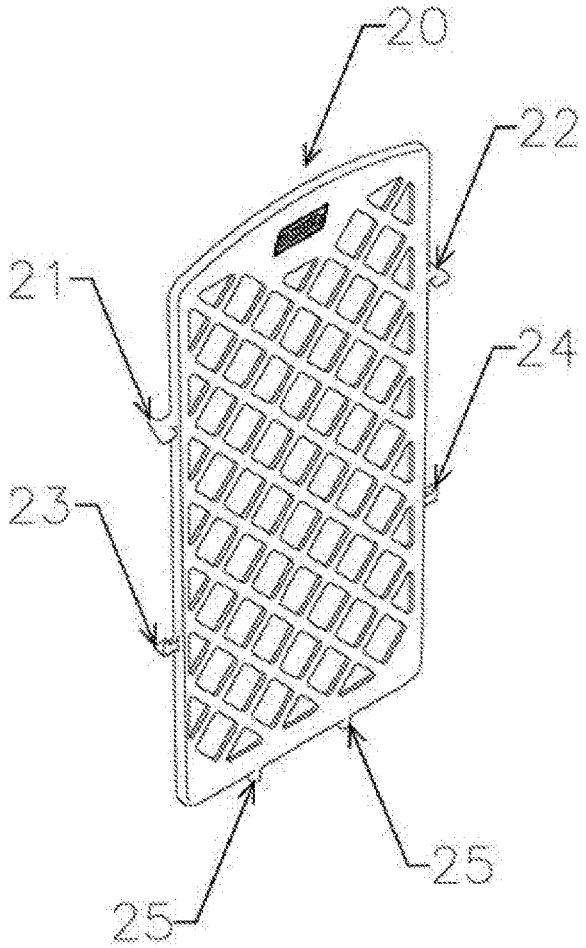
FIG. 7 represents a perspective view of the separator of the basket, showing the hooks that allow attachment to the body of the basket.
Figure 8:
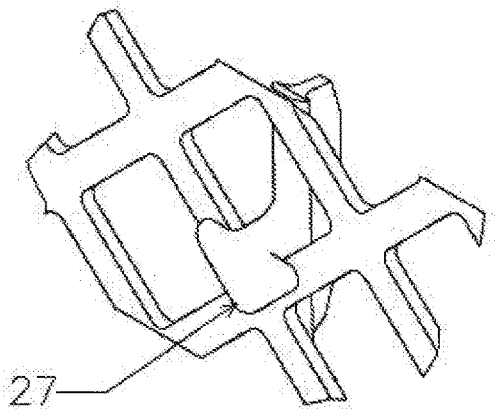
FIG. 8 represents a perspective view of a type of hook that allows for affixing the separator to one of the walls of the body of the basket, this type of hook is a protuberance in the form of a half diamond.
Figure 9:
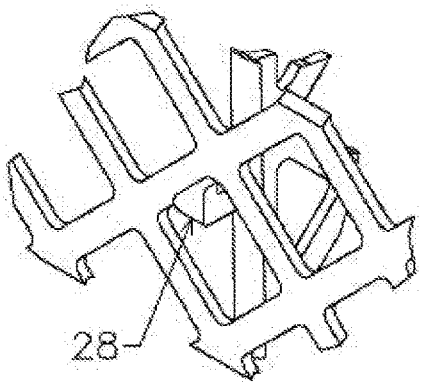
FIG. 9 is a perspective a view of a type of hook that allows to affix the separator to one of the walls of the body of the basket, this type of hook is a protuberance in the form of quarter of diamond or rhomboid.
Figure 10:
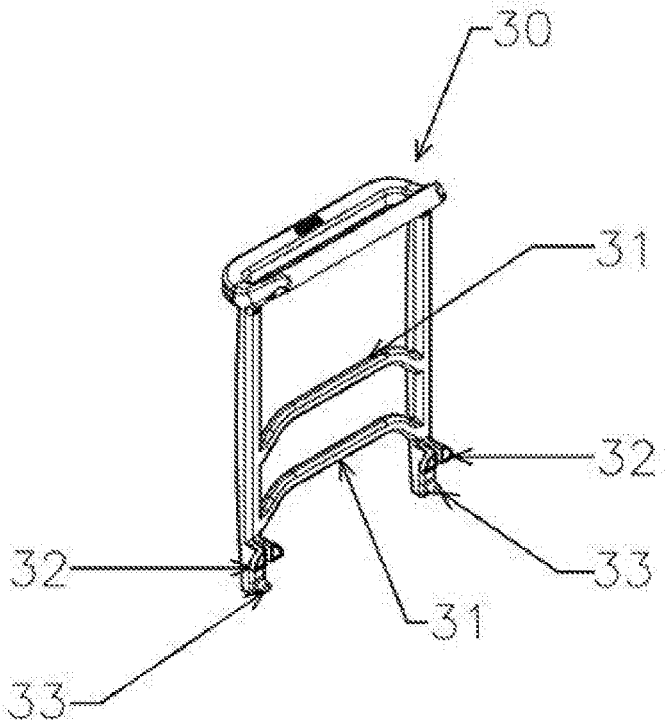
FIG. 10 represents a perspective view of the handle and its hooks to the basket and the preserving machine, among them is the bow anchor, clip type anchor and cylinder anchor.
Figure 11:
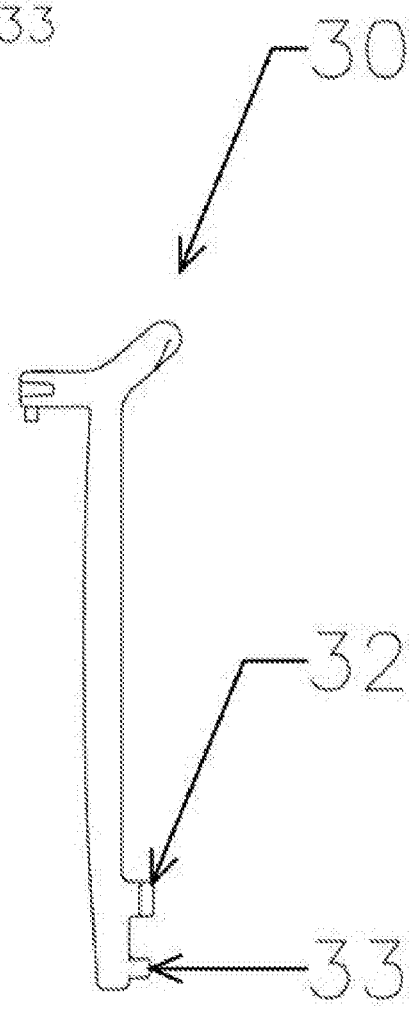
FIG. 11 represents a perspective view of the handle and its hooking system.

In FIGS. 6 and 7, it is seen that the internal separators 20 have lateral projections 21, 22, 23, 24 to be coupled to the body of the container 10. Said upper projections 21, 22 comprise a rhombus-shaped protuberance 27 (FIG. 8), which is located on each side in the upper area of the internal separator; while the lower projections 23, 24 comprise a protuberance in the form of a quarter of a diamond 28 (FIG. 9), which is located on each side in the lower area of the internal separator. The connection between the separator 20 and the body 10 is achieved by said protuberances in the form of a half diamond and the other quarter of a diamond on each side in the separator 20, which point in opposite manner to each other.

The anchoring systems for joining each handle 30 to the container body 10 of basket 1, are of three types, each with a different function and feature, as detailed below:

a) an arch anchor 31, which consists of the union between one of the arches 31 that has the handle 30 with one of the cavities in the rim 16 that has the container body 10, where, according to the model of horizontal preserving machine, the position or corresponding height of the anchor will vary of arch 31 with respect to one of the smaller vertical walls 13, 14 of the container body 10. This type of union fulfills the function of supporting the weight of the ice cream and/or frozen products contained therein; by its arc shape, the force is evenly distributed towards the sides of the handle dissipating and being complemented by the other two types of anchors.

b) a clip type anchor 32, which consists of two protrusions 321 in the form of a semicircle with an intermediate division 322 that allows a slight contraction and pressure when they are fitted in the perforations 131 or 132 similar to a "inverted wine cup" that are located in the smaller vertical walls 13, 14 of the container body 10, acting as consolidation between the container body 10 and the handle 30. These protuberances, once introduced, as they rise through the narrowest part of the perforations are contracted, but due to the elastic force they begin to force in the opposite direction, trying to return to their original shape, causing them to maintain their proper position. As already said, this anchor acts as a consolidation between the container body 10 and the handle 30 and one of its main functions is to prevent the handle from being dislodged due to the lateral forces that may occur when taking the basket and when loaded with frozen products and/or ice cream; and c) a cylinder anchorage 33, which consists of a pair of cylinders 331 of 5.5 mm in diameter, slightly conical and 6 mm high, which are inserted in circular perforations 141 or 142 that are located in the smaller vertical walls 13, 14 of the container body. Particularly, this anchor is slid by a slight drop (1 millimeter deep and 15.5 millimeters high) in the container body 10 until it is inserted into a circular hole 141 or 142 (diameter 6 millimeters) in it. This achieves that the handle 30 does not fall or loosen from the container body 10 when the basket 1 is at rest or when the handle is struck to go down.

d) a bar anchor 34: consists of a transverse bar 341 that runs almost entirely the part opposite the handle 35 on the handle 30, which fits with the chill profile of the horizontal preserving machines, so as to ensure the position of the basket 1 in the machine, independent of the model and whether it is loaded or not with frozen products and/or ice cream.

Due to its configuration and unique design, the basket 1, can be used in both models of horizontal preservers (straight and inclined) simply by changing the position of the handles 30, characteristic that makes it a basket of the standard type, independent of the capacity, shape or volume of the preserving unit.

The main characteristics of the basket for ice cream and/or frozen products of the present invention are:

its removable handles, which also allow to adjust its height by means of the perforations of the basket body, allowing these handles to adapt to different levels, and that is developed in plastic materials that do not rust, lose their shape, and do not crack, being able to easily cleaned. This allows to deliver a solution to the industry of preserving machines by providing a standard product, which can be used in horizontal preserving machines both inclined and straight.

In regards to the materials used in the manufacture of the various components that make up the basket for ice cream and/or chilled products of the present invention, it can be pointed out that the container body 10 and the separators 20 are manufactured from the polymeric material polypropylene (PP), using a recipe that includes: polypropylene (PP) in pellet format; master batch color, in pellet format; master batch UV inhibitor, in pellet format; and anti-static master batch, in pellet format. The type of PP used in the manufacture of both components has a high resistance to impact and low temperatures. Its productive process is carried out by injection. Any expert in the field will be able to produce a mixture appropriate to their requirements. Polypropylene is a thermoplastic that is obtained by the polymerization of propylene, a gaseous by-product of oil refining. Polypropylene can be classified into three types (homopolymer, random copolymer and high impact copolymer), which can be modified and adapted for certain uses. Among its main features are: optimal cost/benefit ratio; versatility, it is compatible with most of the existing processing techniques and used in different commercial applications, such as packaging, automotive industry, textiles, household goods, medicine, pipes, etc.; good ability to process, it is the plastic material of less specific weight (0.9 g/cm$^3$), which implies that a smaller amount is required to obtain a finished product; barrier to water vapor, prevents the transfer of moisture, which can be used for the protection of various foods; good organoleptic, chemical, resistance and transparency properties; transparency, has a superior transparency to the rest of the poly olefins, becoming one of the most used materials in containers and packaging; light, it has a lower specific weight, therefore it allows to obtain lighter pieces in its applications; and recyclable, it does not contain chlorine or aromatic compounds that can affect its energy valuation.

On the other hand, the handles 30 are produced from the polymeric material acrylonitrile butadiene styrene (ABS), using a recipe that includes: ABS in pellet format; master batch—color, in pellet format; and UV inhibitor master batch, in pellet format. The type of ABS used in the manufacture of the handles 30 has a high resistance to high impact and an average brightness. Your production process is carried out by injection and any expert in the field can produce a mixture appropriate to your requirements. ABS materials have important engineering properties, such as good mechanical strength and impact combined with ease for processing. The impact resistance of ABS plastics is increased by increasing the percentage of butadiene content, but then the tensile strength properties decrease and the heat deformation temperature decreases. The wide range of properties exhibited by ABS is due to the properties presented by each of its components. Acrylonitrile provides: thermal resistance, chemical resistance, resistance to fatigue, hardness and rigidity. Butadiene provides ductility at low temperature, impact resistance and fusion resistance. Styrene provides processing facility (fluidity), brightness, hardness and rigidity. Except in thin films, it is opaque and can be dark or ivory and can be pigmented in most colors, obtaining glossy parts with a fine finish. They can be extruded, injection molded, blown and pressed. Generally low impact grades are the easiest to process. The high impact ones are more difficult because having a higher rubber content makes them more viscous. Within a variety of thermoplastics, ABS is important for its balanced properties. ABS stands out for combining two very important properties such as resistance to stress and impact resistance in the same material, as well as being a lightweight material.

The reach of the basket for ice cream and/or refrigerated products that is described in the present invention, should not be limited only to the baskets or components mentioned in the text itself, but this invention covers all that basket comprising the relevant components that are described.

What is claimed is:

1. An ice cream and/or refrigerated products basket (1) for storing ice cream and other refrigerated products within refrigeration machines, said basket comprising:

three components of polymeric removable materials, wherein said three components are detachable from one another, further comprising:

(i) a body container (10) of rectangular volume, formed by four vertical walls (11, 12, 13, 14) and a lower basal wall (15), all perforated in a shape of a plot of geometric figures, wherein two large vertical walls (11, 12) of said four vertical walls are symmetrically identical, and two small vertical walls (13, 14) of said four vertical walls are of different height, with a rear wall (14) being of greater height than a front wall (13);

(ii) at least one internal separator (20) that includes devices of lateral projections (21, 22, 23, 24) and inferior projection (25) to be attached to the container body (10); and (iii) a set of two holding handles (30) that consist, each, of at least three different types of anchors (31, 32, and 33).

2. The ice cream and/or refrigerated products basket (1) of claim 1, wherein the container body (10) is formed by said four vertical walls (11, 12, 13, 14) joined by their respective vertical sides and the lower wall (15) is joined by its edges to the four vertical walls (11, 12, 13, 14).

3. The ice cream and/or refrigerated products basket (1) of claim 2, wherein the vertical walls (11, 12, 13, 14) of the container body (10), have an inclination between 1 and 10 degrees, from its upper edge to its lower edge, so that two or more container bodies (10) can be stacked.

4. The ice cream and/or refrigerated products basket (1) of claim 2, wherein each of the vertical walls (11, 12, 13, 14) of the container body (10), on its upper edge, has a flange curved concave (16), which allows the adjustment of container bodies (10) when they are stacked and the coupling with one of the anchors of the handles (30).

5. The ice cream and/or refrigerated products basket (1) of claim 1, wherein the geometric figure that forms the scheme of the perforated walls, can be: a square, a rectangle, a rhombus, a rhomboid, a circle, an oval, a star of at least three points, or a combination of them.

6. The ice cream and/or refrigerated products basket (1) of claim 5, wherein the geometric figure that forms the scheme of the perforated walls, is preferably a rhombus.

7. The ice cream and/or refrigerated products basket (1) of claim 6, wherein the rhombus can measure from 5 mm by 5 mm and up to 30 mm by 30 mm and have a separation between them of 1 mm and up to 10 mm.

8. The ice cream and/or refrigerated products basket (1) of claim claim 7, wherein the lower wall (15), in addition to the diamond-shaped scheme, includes two longitudinal rows of perforations circular (17) of a diameter that varies between 5 mm and 9 mm, to receive the lower protrusion devices (25) for coupling the internal separator (20).

9. The ice cream and/or refrigerated products basket (1) of claim 8, wherein said circular perforations (17) preferably have a diameter of 7 mm.

10. The ice cream and/or refrigerated products basket (1) of claim 1, wherein an outer surface of the bottom wall (15) of the container body (10) includes eight supports spacers (18) that support and move away the base of the basket (1) with respect to the ground and prevent it from touching the compressor slot of the preserving machine, ensuring a constant cold air flow in the bottom of the preserving machine.

11. An ice cream and/or refrigerated products basket (1) of claim 1, wherein the minor vertical walls (13, 14) include in their upper zone, in a first level, a first pair of perforations (131), each one close to each edge of each wall, and immediately, under said perforations (131), includes a first pair of circular perforations (141) of 6 mm in diameter, said first pair of perforations (131) in a shape of an "inverted wine cup" together said first pair of circular perforations (141), form a first level set (151) for the coupling of the handles (30), in addition, in a second level lower than the first level of the first level set (151) in each of the smaller vertical walls (13, 14), a second pair of perforations (132) each close to each edge of each wall, and immediately, under perforations (132), a second pair of circular perforations (142) of 6 mm in diameter, said second pair of perforations (132) together said second pair of circular perforations (142), form a second level set (152) for the coupling of the handles (30).

12. The ice cream and/or refrigerated products basket (1) of claim 1, wherein the polymeric material of which the container body is made of polypropylene (PP).

13. The ice cream and/or refrigerated products basket (1) of claim 1, wherein the lateral protrusion devices (21, 22, 23, 24) of the internal separator for coupling to the container body (10), comprise: (a) a rhombus-shaped protrusion (27) that is located on each side in the upper area of the internal separator; and (b) a bulge in the form of a quarter of diamond (28) that is located on each side in the bottom area of the internal separator.

14. The ice cream and/or refrigerated products basket (1) of claim 1, wherein the lateral protrusion devices (21, 22, 23, 24) of the internal separator for coupling to the container body (10), comprise: (a) a rhombus-shaped protrusion (27) that is located on each side in the upper area of the internal separator; and (b) a bulge in the form of a quarter of diamond (28) that is located on each side in the bottom area of the internal separator.

15. The ice cream and/or refrigerated products basket (1) of claim 1, wherein the internal separator (20) has perforations in the form of a pattern of geometric figures.

16. The An ice cream and/or refrigerated products basket (1) pf claim 15, wherein said geometric figures correspond to rhombuses or rhomboids.

17. The ice cream and/or refrigerated products basket (1) of claim 1, wherein the polymeric material of which the inner separator is made is polypropylene (PP).

18. The ice cream and/or refrigerated products basket (1) of claim 1, wherein each of the supporting handles (30) consist of three different anchoring types (31, 32, 33) for the union to the container body (10) and a bar anchor (34) that fits with a cold cutting profile of the horizontal preserver machine.

19. The ice cream and/or refrigerated products basket (1) of claim 18, wherein the three different types of anchorage for the joining of each handle to the container body, comprise:

(a) an arch anchor (31), which consists of the union between one of the arches (31) that has the handle (30) with one of the cavities in the flange (16) that presents the container body (10), where, according to the horizontal preserving machine model, will vary the position or corresponding height of the anchor of arch (31) with respect to one of the smaller vertical walls (13, 14) of the container body (10);

(b) clip type anchor (32), which consists of two protuberances (321) in the form of a semicircle with an intermediate division (322) that allows a slight contraction and pressure when they are embedded in perforations (131 or 132) similar to an inverted wine glass that are located on the smaller vertical walls (13, 14) of the container body (10), acting as a consolidator between the body container (10) and handle (30); and (c) a cylinder anchor (33), which consists of a pair of cylinders (331) of 5.5 mm in diameter, slightly conical and 6 mm high, which are introduced in circular perforations (141 or 142) that are located on the minor vertical walls minors (13, 14) of the container body (10).

20. The ice cream and/or refrigerated products basket (1) of claim claim 18, wherein the bar anchor (34) consists of a crossbar (341) that runs almost the entire counterpart to the handle (35) on the handle (30), which fits with the cold-cutting profile of the horizontal preserving machine, in order to ensure the position of the basket (1) in the machine, independent of the model and whether it is loaded or not with frozen or cold products.

* * * * *